US006648968B2

(12) United States Patent
Gambini

(10) Patent No.: US 6,648,968 B2
(45) Date of Patent: Nov. 18, 2003

(54) APPARATUS FOR APPLYING GLUE TO A TUBULAR CORE TO BE FITTED IN A RE-REELING DEVICE FOR WINDING LOGS

(76) Inventor: Giovanni Gambini, Via A. Omodeo 7, I - 56124 Pisa (IT)

( * ) Notice: Subject to any disclaimer, the term of this patent is extended or adjusted under 35 U.S.C. 154(b) by 0 days.

(21) Appl. No.: 10/118,714

(22) Filed: Apr. 8, 2002

(65) Prior Publication Data

US 2002/0144652 A1 Oct. 10, 2002

(30) Foreign Application Priority Data

Apr. 10, 2001 (IT) ..... MI2001A0764

(51) Int. Cl.[7] ..... B05C 1/02

(52) U.S. Cl. ..... 118/249; 118/259; 118/261; 156/578; 242/532.3; 242/533

(58) Field of Search ..... 118/232, 249, 118/259, 261, DIG. 11; 156/578; 242/532.3, 533

(56) References Cited

U.S. PATENT DOCUMENTS 4,931,130 A * 6/1990 Biagiotti ..... 156/446
5,040,738 A * 8/1991 Biagiotti ..... 242/532.3
5,137,225 A * 8/1992 Biagiotti ..... 242/521
5,242,525 A * 9/1993 Biagiotti ..... 156/357
5,820,064 A * 10/1998 Butterworth ..... 242/533.2

* cited by examiner

*Primary Examiner*—Laura Edwards
(74) *Attorney, Agent, or Firm*—Hedman & Costigan, P.C.

(57) ABSTRACT

An apparatus for applying glue to a tubular core in a re-reeling device for winding logs of material in strips in which a conveyor feeds cores, one after another and distanced form on another, in succession, and at controlled speeds, through an arrangement of two rollers rotating at the same speeds and in synchronization with the controlled linear speed of the conveyor. The first rotating roller, is at least partly immersed in a tank of glue, with at least one portion of a generatrix of the first roller coming into contact with the core fed by the conveyor, and the second roller is positioned opposite the first roller and interacts with the core so that the core is fed through without unintended rotation and the glue is applied in a controlled fashion.

8 Claims, 2 Drawing Sheets

Figure 1:
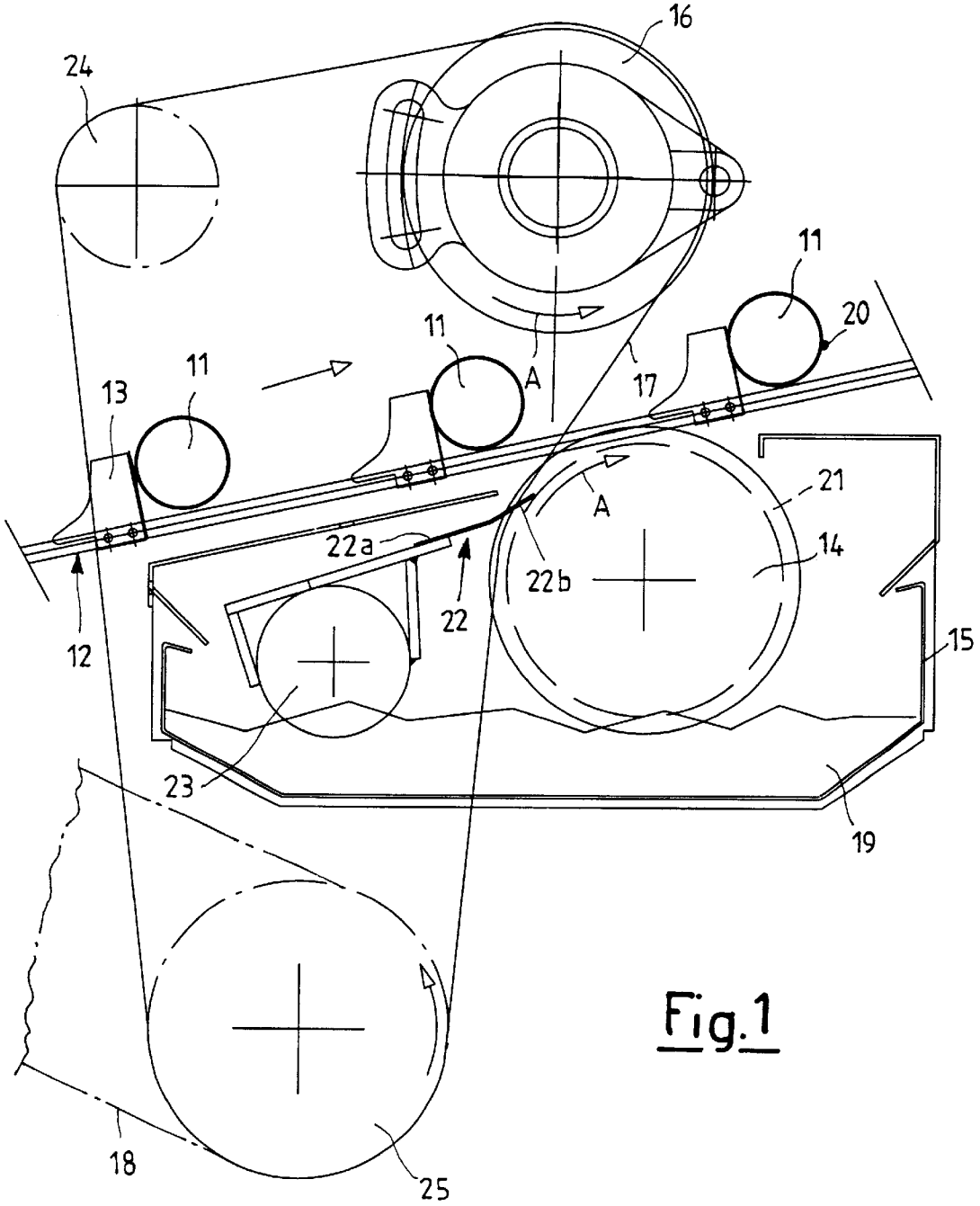

APPARATUS FOR APPLYING GLUE TO A TUBULAR CORE TO BE FITTED IN A RE-REELING DEVICE FOR WINDING LOGS

The present invention relates to an apparatus for applying glue to a tubular core to fit in a re-reeling device for winding logs, in particular for material in paper strips.

In the field of preparation of rolls of toilet tissue, paper for household use and similar, denominated "logs", the state of the art method is to distribute or position glue in various ways on an inner core of the log, so that the initial edge of the paper, fed in a re-reeling device, remains attached firmly to the core.

For this purpose, apparatus to apply glue to the tubular core to be fitted in a re-reeling device for winding logs are known in which the glue is fed by being forced through an opening parallel to a generatrix of a core.

This opening, for instance, is located above a chamber, at the end of a zone with slight pressure, from which there is a continual overflow of glue fed there by force.

In this way the glue comes into contact with the core, which in the meantime is pushed against the glue outlet opening by elements that prevent rotation to allow optimum reception of the glue.

For example, flexible plates are contemplated that yield as the tubular core passes and keep it in contact with the glue outlet opening, preventing rotation. A flat surface, located downstream of the opening, acts as a scraper for the glue deposited on the core which is fed without being able to rotate, this being prevented by the plates. In this way it must be noted that the glue is applied to the core in a non-symmetrical strip, which is thicker in the direction of feed.

The excess glue removed must then be returned to the tank to be subsequently returned under pressure by means of a pump towards the chamber and the outlet opening.

This device requires the plates to be positioned correctly with an elastic load that prevents the cores from rotating during the phase to receive the glue and during the phase to remove the excess glue.

In other apparatus the glue may be positioned in a strip, directed according to a generatrix zone of the core, by means of spray dispensers that foul the machine and do not guarantee a localized position of the glue.

Alternatively, the glue is positioned according to annular strips transverse to the cylindrical section of the core. However, this causes a certain quantity of glue and a certain quantity of paper material to remain unused and fixed by the glue to the core.

The object of the present invention is to produce an apparatus to apply glue to a tubular core to be fitted in a re-reeling device for winding logs, in particular for material in paper strips, which solves the problems of known art highlighted previously.

Another object is to provide an apparatus that is simpler and easier to produce in relation to those known heretofore.

Yet another object is to produce an apparatus to apply glue to a core that does not foul and does not require particular arrangements to re-feed excess glue.

These objects according to the present invention are obtained by producing an apparatus for applying glue to a tubular core to be fitted in a re-reeling device for winding logs as set forth herein.

Further relevant characteristics of the present invention are set forth in the related claims.

Figure 2:
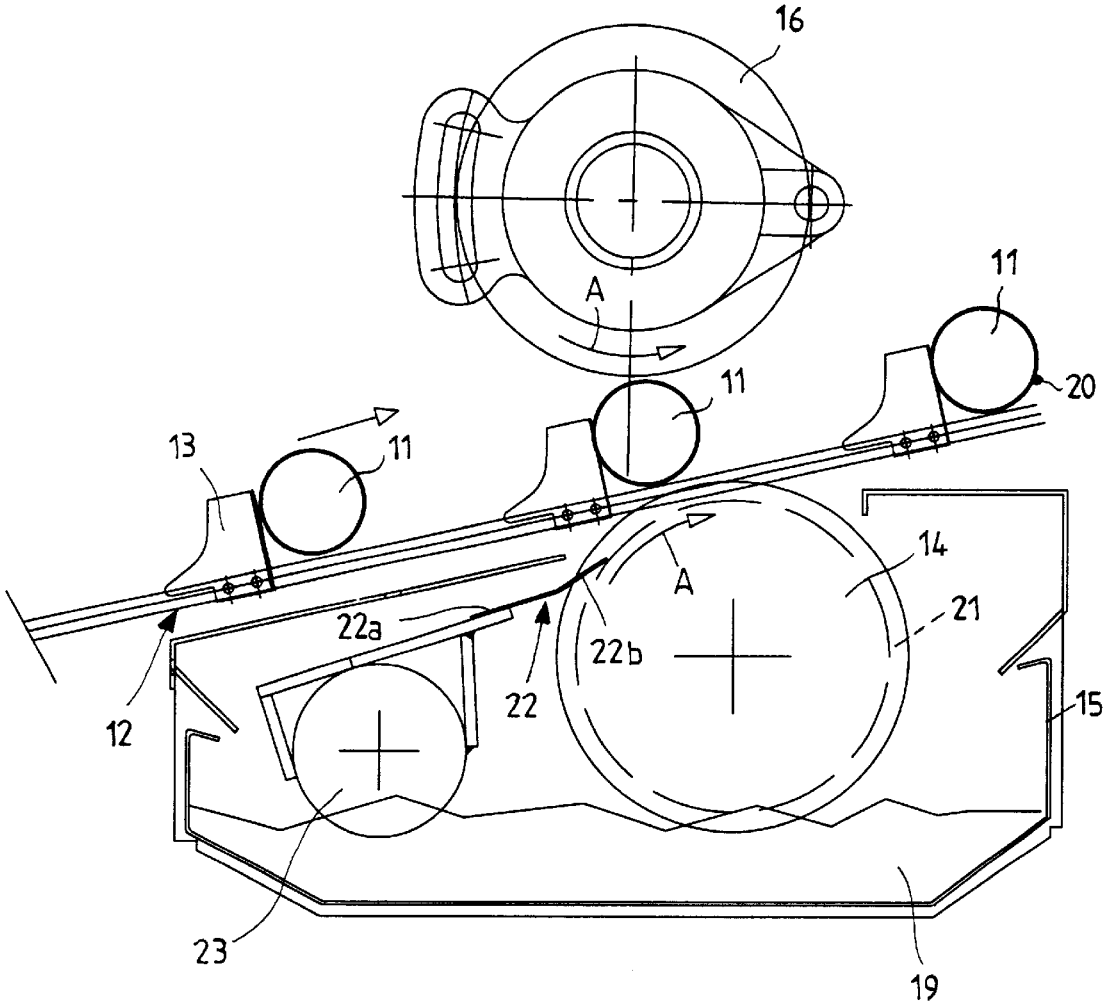

The characteristics and advantages of an apparatus to apply glue to a tubular core to be fitted in a re-reeling device for winding logs according to the present invention shall become more evident from the following description, provided as a non-limiting example, referring to the annexed schematic drawings in which:

FIG. 1 is a side elevation view of an apparatus for applying glue to a core fitted in a re-reeling machine in a first operating phase waiting to receive a core, FIG. 2 is a similar view to the one in FIG. 1 in a subsequent phase of applying glue to the core.

With reference to the figures, these show an apparatus to apply glue to a tubular core to fit in a re-reeling device for winding logs (not shown). The re-reeling device contemplates the feeding of cores 11, for example in stiff tubular material, such as cardboard, by a conveyor 12, for example equipped with pushing devices 13 that receive single cores 11 and transport these one after another and distanced from one another, in succession.

The conveyor 12 feeds the cores 11 towards a means to apply glue to each of these cores laid along its course and comprising the apparatus of the present invention.

In particular, according to the invention, this means to apply glue comprises a first rotating roller 14, at least partly immersed in a tank 15 of glue 19 and which projects at the top beyond this tank 15.

In particular, the first roller 14 is positioned opposite, in relation to the conveyor 12, to a second roller 16, which also rotates at the same speed as the first roller 14. For example, as shown schematically in FIG. 1, the second roller 16 is connected by a transmission 17, for example by means of end toothed belts, to the first roller 14. In this way, deviating rollers and tighteners 24 guarantee, by means of a positive mechanical connection, the same rotation speed and correct direction indicated by the arrow A. Moreover, a pulley 25, which draws movement from the first roller 14, by means of another transmission 18, also for example provided with end toothed belts, allows connection to the conveyor movement transmission 12 (not shown) so that the relevant linear speeds are almost equal.

In the example in FIG. 2, it is seen how at least one portion of a generatrix of the first roller 14 comes into contact with a core 11 fed by a pushing device 13 of the conveyor 12.

This action is performed while the core 11 to receive the glue 19 is between the first roller 14 and the second roller 16 and made to rotate at the same linear speed as the conveyor 12, the three linear speeds being synchronized, as mentioned previously.

In this way the second roller 16, positioned opposite the first roller 14 and also rotating, interacts with the aforesaid core 11 to promote feed synchronized with the feed of the pushing device 13 of the conveyor 12.

Glue 19 is thus applied along a generatrix of the core 11, perfectly and in correct doses and above all only along a glue line, schematically represented by 20 excessively for better comprehension, thanks to the aforesaid rotation performed in perfect synchronism.

In particular, to eliminate all possible excess of glue 19, other embodiments such as those set forth below may be contemplated.

A first embodiment contemplates the first roller 14 with annular cavities, schematically represented by 21 in FIGS. 1 and 2.

These cavities 21 allow glue 19 to be deposited in stretches along a generatrix with a saving of this and at the same time maintaining a good level of adhesion of the paper, not shown, when this is fed onto the core 11.

In addition, although not necessarily, upstream of the first roller 14 a scraping element 22 may be fitted to remove the excess glue 19 carried by the former. For example, this scraping element 22 is composed of a plate with a first end 22*a* connected to an element regulating its engagement on the first roller, schematically represented by a roller 23 rotatable from the outside to engage to a greater or lesser extent with the first roller 14. A second free end 22*b* is shaped complementarily to the first roller 14 provided with cavities 21 and engages with it. Hence this end has a comb shape that engages in the various annular cavities 21.

The glue 19 in excess is hence scraped from the first roller 14 that rotates, immediately before it touches the core 11 to which the glue is to be applied, and falls back into the tank 15 to prevent any fouling of the entire apparatus.

Therefore the pre-established objects on which the present invention is based are accomplished and the noteworthy advantages of this apparatus are also evident.

The apparatus of the present invention thus conceived is susceptible to numerous modifications and variants, all coming within the invention. Moreover, in practice the materials used, their dimensions and components may vary according to technical requirements.

What is claimed is:

1. Apparatus for applying glue to a tubular core in a re-reeling device for winding logs of material in strips, said apparatus comprising a conveyor (12, 13) which sequentially feeds cores (11) which are distanced from one another, in succession, at a controlled conveyor speed through a means (21, 15, 16) for applying glue (19) to each of said cores (11), wherein said means for applying glue comprises a first and a second rotating roller that are rotated at substantially the same speed of rotation said rotation speed being synchronized with said controlled conveyor speed, said first roller (14), being at least partly immersed in a tank (15) of glue (19), with at least one portion of a generatrix of said first roller (14) coming into contact with the core (11) which is fed by said conveyor (12, 13), at said controlled conveyor speed, and said second roller (16), being positioned opposite said first roller (14), with said first and second rollers interacting with said core (11) to cause said cores (11) to be fed without rotation through said means to apply glue in synchronization with the feed of said conveyor (12, 13).

2. Apparatus as claimed in claim 1, wherein said at least one portion of the generatrix of said first roller (14) is composed of linear stretches, said first roller (14) being provided with annular cavities (21).

3. Apparatus as claimed in claim 1, wherein upstream of said first roller (14) a scraping element (22) is fitted to remove the excess glue (19) carried by said first roller (14) before said first roller comes into contact with said core (11) that receives glue.

4. Apparatus as claimed in claim 2, wherein upstream of said first roller (14) a scraping element (22) is fitted to remove the excess glue carried by the former (22), where said scraping element (22) has a free end (22*b*) shaped complementary to said first roller (14) which engages with said cavities (21) that are annularly arranged within said first roller.

5. Apparatus as claimed in claim 3 or 4, wherein said scraping element (22) is fitted in said tank (15).

6. Apparatus as claimed in claim 3 or 4, wherein said scraping element (22) is fitted in said tank (15) on a roller (23) rotatable from the outside to engage to a greater or lesser extent with said first roller (14).

7. Apparatus as claimed in claim 1, wherein said controlled conveyor speeds and said speeds of said rotating first and second rollers are synchronized by means of positive mechanical connections.

8. Apparatus as claimed in claim 7, wherein said positive mechanical connection comprises a connection between a pulley (25), said first roller (14) and said conveyor (12) by a means of one or more apparatus selected from the group consisting of a toothed belt and a chain.

* * * * *